US005577286A

United States Patent [19]

Smith et al.

[11] Patent Number: 5,577,286

[45] Date of Patent: Nov. 26, 1996

[54] HIGHWAY DEBRIS ENTRAINMENT AND STORAGE DEVICE

[75] Inventors: Owen Smith, Scottsdale, Ariz.; Charles C. Holley, Bloomington, Minn.; William E. Daniels, Jr., Paola, Kans.

[73] Assignee: The Toro Company, Bloomington, Minn.

[21] Appl. No.: 293,366

[22] Filed: Aug. 19, 1994

[51] Int. Cl.[6] ..... E01H 1/04

[52] U.S. Cl. ..... 15/84; 15/83; 15/179; 56/328.1; 56/364

[58] Field of Search ..... 15/83, 84, 340.3, 15/340.4, 179, 85, 86; 37/305; 171/116; 134/6; 300/21; 56/328.1, 364

[56] References Cited

U.S. PATENT DOCUMENTS

| | | | |
|---|---|---|---|
| 2,917,761 | 12/1959 | Burgdorff | 15/84 |
| 2,928,225 | 3/1960 | Spencer | 15/84 |
| 3,186,015 | 6/1965 | Beyerstedt | 15/84 |
| 4,593,426 | 6/1986 | Chrisley | 15/84 |

*Primary Examiner*—Mark Spisich

*Attorney, Agent, or Firm*—David George Johnson

[57] ABSTRACT

A refuse collection device (1) including a collector roller (11) and an inclined conveyor (27) which deposits collected debris into a hopper (127) along arcuate paths (128, 129), thereby filling the hopper (127) initially in the region adjacent to its rear wall (130). Mounted on the collector roller (11) is a plurality of rubber fingers (13, 14, 15, 16) arranged in rows (17, 18, 19) which are laterally offset from substantially identical rubber fingers (39, 40, 41), also arranged in rows (32, 33, 34) so as to occasionally form a substantially continuous, upwardly moving entrainment platform (150) and to also occasionally form an arrangement of spaced apart fingers which each transport debris onto the conveyor (27). The collector roller (11) is attached to a biasing means (118) so as to permit the collector roller (11) to travel over excessively large debris without interference. The conveyor (27) is inclined at an approximately forty five degree angle, the upper conveyor axle (26) being supported by a bearing (123) which may be adjustably mounted within a slot (124) and on alternate parallel frame members (10, 115) so as to maintain the desired clearance from the road surface (6) as the rubber fingers (14, 15, 16, 40, 41) shorten due to wear. A carcass storage box (131) is pivotably mounted along the lower edge (140) of the hopper (127) to segregate refuse which must be disposed of separately.

13 Claims, 11 Drawing Sheets

HIGHWAY DEBRIS ENTRAINMENT AND STORAGE DEVICE

BACKGROUND OF THE INVENTION

1. Field of the Invention

The present invention is directed generally to the field of debris removal, and specifically to an apparatus that is capable of retrieving a wide variety of litter and refuse from any type of surface, such as a road surface, while the apparatus is in continuous forward motion.

2. Description of Related Art

A common type of litter collecting device includes a single pick up roller or drum rotatably supported on a frame which is movable over the ground. In its simplest form, the device is simply a sweeper, an example of which is disclosed in U.S. Pat. No. 3,771,189, issued to Horton et al. Resilient fingers project from the rollers to entrap, or at least redistribute, litter during rotary contact with the ground. The entrapped litter is then lifted from the ground by the fingers as the roller or drum rotates.

If the device is to be used to actually entrap and store the litter, a smaller, elevated brush roller downstream from the pick up roller can be employed to remove and transfer trapped litter from the fingers for discharge into a trash bin carried by the frame. An example of such a device is disclosed in U.S. Pat. No. 3,923,101, issued to Donahue.

The major problem encountered by such roadbed engaging devices is brush or finger wear. The brush must have some resilience in order to avoid breaking when repeatedly encountering the unyielding road surface. Thus, numerous researchers have addressed the problem of designing a strong wear resistant brush capable of some deflection, the proper amount of deflection often being a somewhat poorly defined parameter. For example, U.S. Pat. No. 3,649,984, issued to Kershaw et al., discloses a brush element having a protruding steel core surrounded by a rubber sheath. The steel core limits maximum deflection while adding a substantial weight penalty. Hence, the roadbed sweeper with which such bristles are used is required to have a substantial power source as well as a relatively rugged transmission. A similar rubber element reinforced with a series of spring steel plates is disclosed in U.S. Pat. No. 4,484,373, issued to Price. The use of bundles of bare wire brush elements without any sort of coating is disclosed in U.S. Pat. No. 4,662,044, issued to Kayabara.

An attempt to utilize a more resilient brush or finger is disclosed in U.S. Pat. No. 2,286,650, which uses a brush element formed of pure gum rubber. Additional flexibility is obtained by cutting a series of lateral grooves into the exterior of the brush element. However, the brush disclosed is far too fragile to withstand repeated contact with a road surface, and is in fact intended for use with a poultry plucking machine. A somewhat stronger brush is disclosed in U.S. Pat. No. 4,480,350, issued to White, which uses a substantially identical brush element as found in the '650 disclosure, with the addition of internally molded fiber reinforcing elements. U.S. Pat. No. 4,367,564 discloses a stiffer brush element having a rounded leading edge and reinforced by an internally molded, stranded, fibrous material.

All of the above mentioned brush elements suffer from being excessively heavy and requiring the combining of multiple materials into a specific composite structure. Further, each of the aforementioned brushes must be individually mounted by threading into a receptacle or being individually secured by separate threaded fasteners. Such mounting arrangements are a major source of dissatisfaction in a litter collecting environment, since debris tends to foul such fastening arrangements and tools are required to replace each individual brush. An attempt to simplify the mounting of the brush is disclosed in U.S. Pat. No. 5,160,187, issued to Drumm, in which a continuous brush is mounted to a continuous clip which is then inserted into a groove residing on the rotating drum. However, a method of adapting such an arrangement to a series of discrete finger elements is not disclosed.

While the above devices are somewhat effective to remove certain types and quantities of litter scattered over relatively large areas, the rotating pick up fingers often fail to initially engage or retain entrapped litter for subsequent removal by the elevated brush roller. Consequently, substantial quantities of litter remain on the ground. Additionally, substantial quantities of litter lifted by the fingers are often ejected back onto the ground by the rotating brush roller.

Another type of litter collecting apparatus utilizes a tandem pair of identical, oppositely rotating rollers, as disclosed in U.S. Pat. No. 2,916,753, issued to Redpath et al. Each roller supports many radially extending fingers which engage the ground, and which also intermesh in a gear like fashion with the fingers of the adjacent roller. This type of prior art apparatus tends to lift greater quantities of litter from the ground than the single roller/elevated brush arrangement discussed above, since litter not grasped by the front roller fingers is usually lifted by the rear roller fingers.

In order to transfer litter to a downstream conveyor for discharge into a rear trash bin, Redpath et al. uses plural elevated, finger projecting rollers meshing with front and rear finger projecting, ground level rollers. The elevated and ground level rollers convey litter downstream along an arcuate transfer path above the ground level rollers. Difficulties are encountered, however, in maintaining precise control over transfer of litter entrapped between the fingers of the ground level rollers. Specifically, there is a tendency for the elevated rollers to redeposit entrapped litter onto the ground since the fingers cannot maintain positive control over all types of litter so as to insure movement to the conveyor residing along the same transfer path. Also, whereas the rollers yield to uneven terrain, the equipment is complex and cumbersome, increasing production and maintenance costs.

In all of these machines, the transfer of the collected litter from the collector to the storage bin involves a number of discrete handling steps in which the litter goes from one location to another between the ground and the storage bin. However, each time that a piece of litter must be handled by a separate piece or structure in the machine there exists an opportunity for the overall collecting efficiency of the machine to be reduced. For example, when a transfer of litter between two relatively moving machine elements is required, it is always possible that flexible types of litter such as cardboard cartons or paper wrappers can become jammed between the two elements. Rather than being transferred from one element to the other, the litter may be returned to the ground or require stoppage of the machine to clear the obstruction.

In another type of entrainment action, collected litter may be allowed to freely drop from one type of handling apparatus into another. For example, it may fall from a collecting roller into a trap area where it is picked up by a subsequent handling device. In such situations, it is entirely possible that litter such as a glass bottle or the like may break as it falls into the trap area, allowing the smaller pieces to drop through spaces in the machine and return to the ground.

U.S. Pat. No. 3,993,141, issued to Donahue, employs a relatively simple collecting concept that does not involve numerous handling steps in transferring the litter from the collecting device to the storage bin. However, the basic collecting device itself is too simple in concept, comprising a series of relatively rigid rods mounted on a shaft and adapted to picking up only certain types of litter or litter of certain sizes that is capable of being wedged between the rods.

U.S. Pat. No. 4,550,465, issued to Chrisley, utilizes a plurality of flexible fingers to collect litter, the fingers being subject to wear, thus reducing their effectiveness. The fingers in such prior art machines are difficult to replace, and their circular cross section tends to deflect rather than entrain at least some portion of the debris.

U.S. Pat. No. 5,247,717, issued to Smith, also utilizes flexible fingers arranged on opposed conveyors to lift debris entrained by a pair of ground engaging rollers. The fingers are intermeshed so as to increase the probability of entraining and transferring a high percentage of the litter, and the multiple conveyor scheme reduces the horizontal length of the litter collecting apparatus, leaving a greater length available for use as a collection hopper for a vehicle of a given size. However, the intermeshed fingers require a controlled timing sequence among the various rollers that prevents rapid variations in conveyor and collector speeds. Further, certain types of litter, such as blankets or carpeting, tend to become entangled in the intermeshed fingers which define a relatively tortuous path for the entrained litter. The intermeshing of the fingers and the spacing of the opposed conveyors impose a finite limit on the size of the debris which may be transported through the space in between the conveyors. Although the collection bin is potentially enlarged, there is no mechanism to insure that substantially the entire volume of the bin will be filled before the proximity of the collected debris to the conveyors will preclude further debris entrainment. Finally, the length of the vehicle is such that the collection bin is necessarily behind the rearmost wheels of the vehicle, resulting in wide center of gravity variations and undesirable low frequency undamped resonant oscillations of the entire vehicle at certain, unpredictable speeds.

U.S. Pat. No. 4,434,011, issued to Moore, discloses a litter collection device in which a series of fingers engage the ground and transfer entrained litter to a single conveyor. Rotating discs are interposed between each row of fingers to strip entrained debris and direct it to the conveyor. The ground engagement feature of this device promotes a high rate of finger wear, while the rotating discs add substantial mechanical complexity and power transmission requirements.

In summary, previously developed litter collecting machines have not solved the problem of collecting the wide variety of litter that is commonly found on surfaces such as, for example, highways. In particular, the previous devices have been subject to incomplete litter collection, jamming and fouling of collection elements, poor utilization of the available collection bin volume, limitations on the size and shape of the debris which can be entrained and an inability to operate while in motion at any substantial forward velocity. The lack of reliability of prior art debris pick up devices has caused most public safety departments with responsibility for high speed limited access highways to routinely block traffic in all lanes in anticipation of debris removal by a stationary vehicle assisted by pedestrian personnel. This practice is inherently dangerous, slow and labor intensive.

SUMMARY OF THE INVENTION

The present invention addresses some of the problems associated with litter collection on a surface such as is found, for example, in highway environment. An ideal highway litter collection device should be able to pick up a wide variety of large and small objects that are potential hazards to vehicular traffic. These commonly include such diverse items as dead animals, automotive mufflers, boxes, newspaper, carpets, mattresses and bottles. Further, the collection should be accomplished at as rapid a forward velocity as possible by a single vehicle which does not substantially disrupt traffic flow and which can preferably be operated by one person without assistance. The collection bin on the vehicle should preferably be able to accommodate enough debris such that the bin does not need to be emptied more than twice a day, thereby permitting, for example, the vehicle operator to make all required pickups without interruption until the normal lunch break, at which time the bin may be conveniently emptied. Insofar as certain types of debris, such as dead animals, cannot be disposed of with other types of litter, the collection bin should provide means for segregating such refuse so that it may be conveniently emptied at the appropriate time. Finally, the collection device should be simple enough in design and construction so that fouling, jamming and maintenance are minimized.

Accordingly, the present invention includes at least one collection roller and an associated conveyor, each driven at independent and possibly nonintegrally related speeds. The collection roller includes multiple rows of flexible paddles which are laterally offset from, but radially overlapping with, rows of substantially identical flexible paddles mounted on the conveyor. Since the paddles of the collection roller are offset laterally from the paddles of the conveyor, there is, in one preferred embodiment, no need to provide for a timing sequence to synchronize their relative rotations. Depending on the relative rates of rotation between the collector roller and the conveyor roller, an operating condition is achieved in one preferred embodiment which offers the advantage that the paddles extending from the collector and conveyor will form a substantially continuous surface between the two rollers for entraining and lifting debris for portions of each complete revolution of the collector roller. Operation of the conveyor at a somewhat higher speed than the collector roller also offers the advantage of greater debris entrainment.

The flexible paddles employed in one embodiment of the present invention are tapered, having a relatively wide base region and a narrow tip portion. The paddles are also formed so as to have a substantially rectangular cross section. The small clearance between the paddles of the conveyor and the paddles of the collector rollers at their point of closest contact has the added effect of entraining a substantial amount of air and urging it toward the collection hopper, which has the benefit of transporting small or lightweight debris into the hopper which would otherwise be redeposited on the ground.

The conveyor is inclined at a steep enough angle with respect to the roadway surface, and also has a sufficiently short overall length, such that the projected horizontal length of the conveyor is relatively short, permitting the vehicle to be operated on conventional roads by vehicle operators potentially having average driving skills. Due to the abbreviated length of the conveyor assembly, the collection hopper is longer, and hence has a relatively greater volume, for a vehicle of a given length. The conveyor belt is supported at its lower end by a roller having a first diameter, while its upper end is supported by a roller having a second, somewhat smaller diameter. The geometrical relationship of the first and second rollers results in the conveyor moving at an accelerated angular pace near the top of the conveyor, and this angular acceleration, combined with the resilience of the flexible paddles, results in a flicking or hurling action at the tip of the paddles as they pass over the top conveyor roller, thereby tending to propel the entrained debris along an arc that terminates at the rear of the hopper. This debris deposition path tends to insure that the hopper is filled from the rear and advances forwardly until the entire volume of the hopper is utilized.

Additionally, in a preferred embodiment of the present invention, the collection bin or hopper can be inclined up to an angle of approximately sixty five degrees in order to assist in shifting the hopper's contents rearwardly if the normal debris discharge arcing path is insufficient by itself to properly load the hopper. Also, the position of the wheels underlying the collection bin may be adjusted along the longitudinal axis of the vehicle frame, thereby permitting adjustment of the vehicle center of gravity as may be necessary for an unloaded, partially and fully loaded collection bin. For unloading, the collection bin is mounted on rails formed as part of the vehicle frame, thereby permitting the bins to be slidably replaced in a minimum amount of time. A series of novel mechanical aids further facilitates the collection bin loading and unloading operations.

The collection bin also includes an internally mounted pivoting shelf which forms a compartment for storing debris which must be segregated, such as animal remains. A series of pulleys and cables permits remote positioning of the pivoting shelf by the vehicle operator. Further, a pivotable, internally mounted baffle permits the positive routing of debris to the appropriate section of the collection bin. A central region of the collection bin directly overlies the rearmost axle of the vehicle, thereby minimizing center of gravity variations and undesirable vehicle oscillations resulting therefrom.

A novel mounting arrangement permits the flexible paddles to be mounted to the collection roller and conveyor without damage to the underlying conveyor belt, and facilitates removal and replacement of the paddles. Further, the entire conveyor/collector assembly may be pivoted to adjust its position relative to the highway surface, thereby permitting height adjustments in response to wear of the flexible paddles.

In one embodiment, the collection roller is spring biased toward the conveyor, thereby permitting the collection roller to deflect forwardly in response to the presence of unusually large articles and thus increase the maximum dimension of the passageway or path defined by the space between the collector and conveyor. Also, the collector roller is supported or suspended along an axis having a substantial vertical component such that the downward force exerted by the collector roller on an item to be entrained is substantially less than the weight of the collector roller, thereby permitting the collector roller to climb or travel over the article. This "walk over" motion of the collector simplifies the entrainment of larger articles which can be more readily collected by the action of the conveyor alone. In one embodiment, the collector roller can be raised by the vehicle operator substantially above the lower end of the conveyor, thereby preventing interference by the collector roller with larger debris whose entrainment would otherwise be blocked or impeded by the presence of the collector roller.

DETAILED DESCRIPTION OF THE INVENTION

Figure 1:
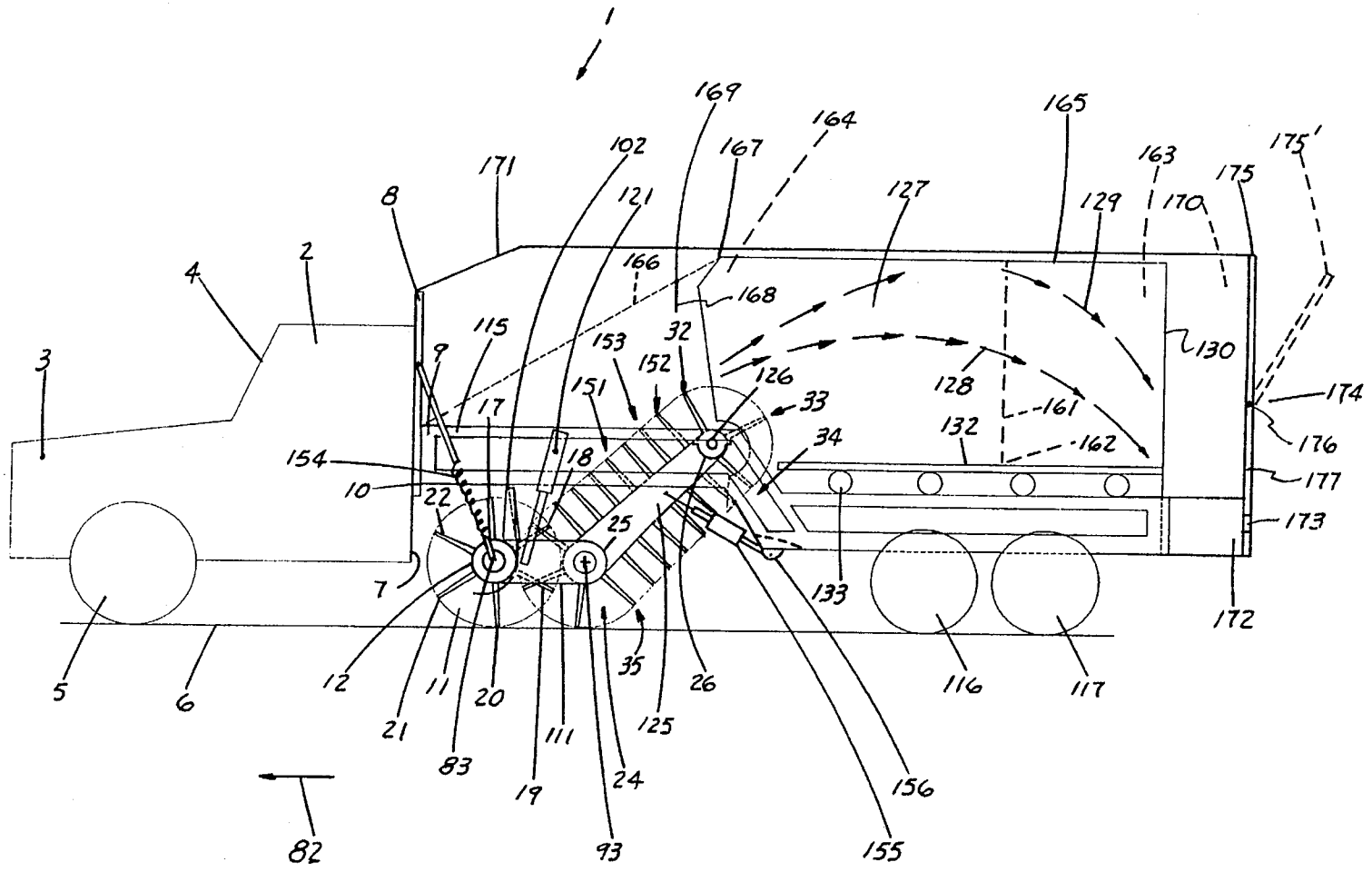
FIG. 1 is a left side elevation of a debris entrainment apparatus embodying the principles of the present invention.

Referring to FIG. 1, a debris entrainment and collection device 1 constructed according to the principles of the present invention is seen to include in a preferred embodiment a vehicle cab 2 which may be, for example, the forward portion of a conventional pickup truck or similar type of vehicle. The cab 1 includes a forward engine compartment 3, windshield 4 and front tire 5 adapted to travel over the road surface 6. The cab 2 is truncated immediately behind the passenger area, the rear surface 7 of cab 2 being rigidly affixed to at least one vertical post 8 which serves as a cab stiffener and support for frame 9. The frame 9 extends rearwardly for the remainder of the length of the collection device 1, and serves to support most of the components associated therewith. While the embodiment described herein is a single, unitary vehicle, the following components to be described may also be mounted on a separate vehicle framework which is towed behind a conventional truck.

Figure 2:
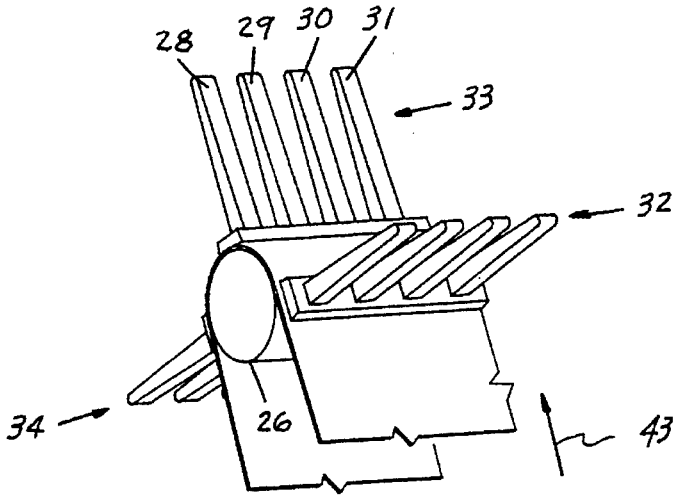
FIG. 2 is a right side perspective view of the collector and conveyor as depicted in FIG. 1, with some parts omitted for clarity.
Figure 2:
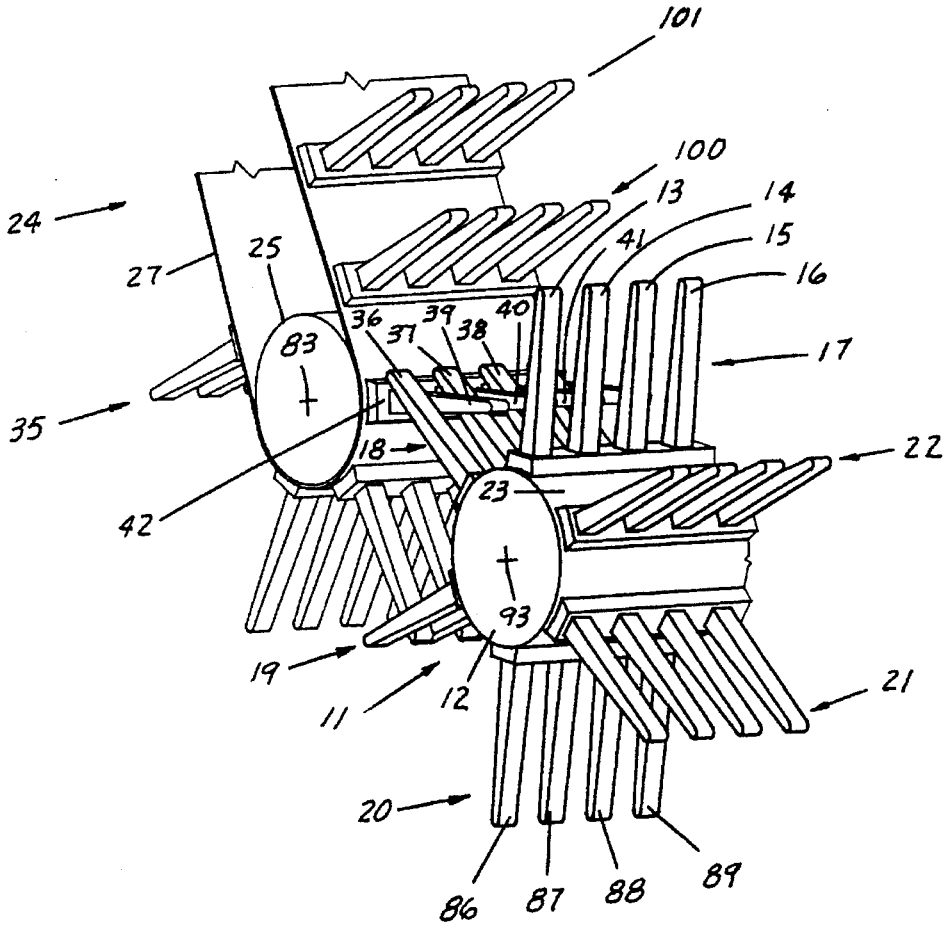

Immediately behind rear surface 7 of cab 2 and generally below the lower frame member 10 is a collector roller 11. Referring also to FIG. 2, the collector roller 11 is seen to include a central cylindrical axle 12, the axle 12 being formed of a strong, rigid material such as steel tubing or sheet and having a diameter of approximately ten inches. The length of axle 12 is approximately six feet. Mounted onto the axle 12 is a series of rubber fingers 13, 14, 15 and 16 for example, which may be arranged in rows of eighteen, each finger 13, 14, etc. being equally spaced from the next finger by a distance of approximately two inches. Six rows 17, 18, 19, 20, 21 and 22 of the rubber fingers 13, 14 etc., can be mounted on axle 12, the rows being equally spaced around the perimeter surface 23 of axle 12. Other arrangements and spacings may be used depending on a variety of factors, such as vehicle width and length, hopper position, and the particular type of debris to be entrained.

The rubber fingers 13, 14, etc., are approximately one foot in length and have a width of somewhat less than two inches. In a preferred embodiment, the rubber fingers can be molded of a gum or vulcanized rubber material having a durometer of approximately eighty, although other durometers could be used for specific applications. In general, a high durometer provides a maximum useful life when the device 1 is used in an environment of paved road surfaces and dense or jagged debris, such as metal or glass. A lower durometer might be appropriate if a specific type of litter, such as wet newspapers or cardboard, were expected to be consistently encountered. The durometer of the finger 13 need not be identical to the durometer of finger 14, but may be mixed in a variety of arrangements.

For example, the durometer of fingers near the edge of the vehicle may be higher in order to deal with the presence of curb structures, or fingers of different durometers may be interlaced to assist in the lateral movement of debris across the axle 11 in addition to its vertical transport. In other words, individual finger durometers and dimensions may vary within the device 1 in order to create rippling or wave like effects which may be useful in entraining certain types of debris, such as moist newspapers. A similar result could be achieved with fingers of substantially identical durometer but having different dimensions, thereby altering the overall stiffness of the individual fingers. In any event, the height of axle 11 is preferably adjusted so that the tip of each finger 13, 14, etc., clears the road surface 6 by a distance of somewhat less than an inch, thereby preventing direct wear against the road surface 6 but still be close enough to the road surface to successfully entrain most types of debris which would pose a hazard to vehicular traffic.

Mounted rearwardly of the axle 11 is conveyor 24, the conveyor 24 extending between a lower axle 25 and an upper axle 26. The length of the conveyor 24 may be, in a preferred embodiment, approximately four feet, the length of conveyor belt 27 being somewhat less than nine feet when fully unwrapped from the axles 25 and 26. Rigidly affixed to the conveyor belt 27 are a series of rubber fingers 28, 29, 30 and 31, etc., the rubber fingers 28, 29, etc., being in one embodiment substantially identical to the fingers 13, 14, etc., already described. In other applications, the fingers 28, 29, etc. may be altered in shape, dimensions and stiffness as required by the operating conditions expected to be encountered. The rubber fingers 28, 29, etc., are arranged in rows of seventeen fingers each, the rows extending laterally across substantially the entire width of the conveyor belt 27. The belt 27 includes twenty rows 32, 33, 34, 35, etc., of the fingers 28, 29, etc., and each row is laterally offset from the rows 17–22 of axle 11 such that the fingers of the conveyor are beside, rather than in front of, the adjacent fingers of the collector drum 12.

For example, the fingers 36, 37 and 38 of the collector drum 12 are seen to be beside the adjacent fingers 39, 40 and 41 of the conveyor. Further, the spacing between the collector axle 12 and the conveyor axle 25 is such that the tip of collector finger 36, for example, clears the base 42 of conveyor finger 39 by a distance of less than an inch. The spacing between the side of, for example, collector finger 36 and the side of conveyor finger 39 is preferably approximately a half inch or less. Thus, during those times that rotation of the collector axle 12 and conveyor axle 25 causes the collector fingers 36, 37, etc. to be parallel to conveyor fingers 39, 40, etc., a substantially continuous platform or surface is formed by the adjacent fingers, thereby aiding in the entrainment of debris and its transfer to conveyor 24. The occasional formation of such a continuous platform is a desirable condition, as is the occasional creation of wide gaps between the interlaced fingers. Each condition is best suited to capturing certain types of debris, and the alternating existence of each mode of operation, occurring at least several times per minute, is a feature of a preferred embodiment of the present invention.

The diameter of lower conveyor axle 25 is approximately one foot, whereas the diameter of upper conveyor axle 26 is approximately ten inches. This variation in diameters causes the angular velocity of belt 27 in the region of upper axle 26 to be higher than the angular velocity of belt 27 in any other region, meaning that the tips of the fingers residing in the position of row 33 as depicted in FIG. 2 will be accelerating as they pass over axle 26, since the tip velocity is roughly equal to the angular velocity multiplied by the length of the finger. The acceleration of the tips of the fingers 28, 29, etc., combined with the resilience of the rubber fingers themselves, results in a flinging action in the direction of belt movement as indicated by arrow 43.

Figure 3:
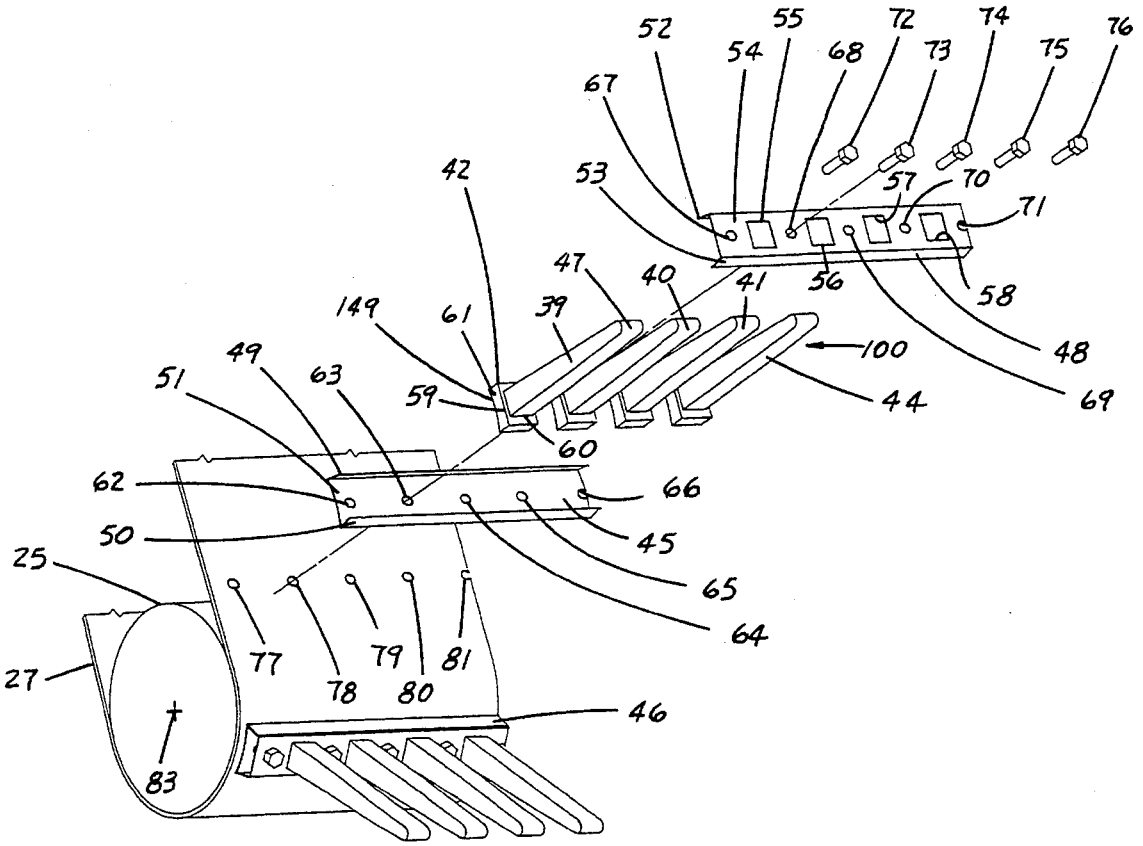
FIG. 3 is an exploded perspective view of the conveyor as depicted in FIG. 2.

Referring also to FIG. 3, the structure of the rubber fingers and the novel manner of mounting the rubber fingers to the conveyor 27 will now be described. The rubber finger 39, for example, is formed with a rounded tip region 47 having a radius of approximately one half inch. The finger 39 has a rectangular cross section which is approximately one half inch by two inches near the tip region 47, increasing to approximately two inches by two inches at the junction with mounting base 42. The mounting base 42 is integrally formed with the remainder of finger 39, but represents an abrupt increase in cross section to approximately 2.50 inches by 2.50 inches. The base 42 has a height of approximately one half inch. The corners formed by the adjacent sides of the finger 39 intersect at substantially orthogonal edges except immediately adjacent to the rounded tip region 47. The finger 39 has an initial overall height of approximately one foot, but as the finger wears during use, it erodes toward base 42 until it reaches a practical minimum height of approximately four inches. The particular shape and dimensions just described and illustrated for finger 39 have been found to be particularly advantageous in entraining and conveying a wide variety of debris encountered on roadway surfaces, including such diverse items as wet newspapers and cardboard, bottles, blankets, automotive mufflers, animal carcasses and furniture.

Although the following explanation addresses only the mounting of some of the fingers 39, 40, 41, 44, etc., to the conveyor belt 27, all of the rubber fingers may be affixed to the conveyor belt 27 in like manner. The belt 27 is preferably composed of a flexible material such as reinforced rubber or plastic. In order to affix the rubber fingers 39, 40, etc., to the belt 27, the stiffness of the belt in the region of the fingers must sometimes be substantially increased. The individual rubber fingers 39, 40, 41, 44, etc., are placed within a lateral base channel 45, 46, etc., which is formed of a rigid material such as metal. The channel 45 extends across substantially the entire width of belt 27, and includes inwardly tapering sidewalls 49 and 50 which extend upwardly from channel bottom surface 51 for a distance of approximately one half inch. The bottom surface 51 is slightly concave so as to better adapt to the shape of the conveyor axles 25 and 26, the bottom surface 51 having a radius of curvature of approximately one foot.

In order to secure the fingers 39, 40, 41, 44, etc., to channel 45, a retainer 48 is utilized. The retainer 48 is formed of a rigid material such as metal and includes outwardly tapering sidewalls 52 and 53 which extend downwardly from the retainer top wall 54 a distance of approximately one half inch. A series of substantially rectangular or, in a preferred embodiment, square orifices 55, 56, 57, 58, etc., are formed within retainer 48, the orifices being suitably shaped and dimensioned so as to provide an interference fit with, for example, the lower portion 59 of finger 39, the lower portion 59 residing just above the junction 60 which the tapering portion of finger 39 makes with its rectangular base 42. A finger 39, 40, 41, 44, etc., is inserted into each orifice 55, 56, 57, 58, etc., respectively, and the retainer 48 is place over channel 45 such that the sidewalls 52 and 53 of retainer 48 reside outside of sidewalls 49 and 50, respectively, of channel 45 in an abutting relationship. In a preferred embodiment, the longitudinal axis of the radiused tip region 47 is oriented so as to be parallel to the axle 11.

In order to secure the retainer 48 to the channel 45 and thus secure the fingers 39, 40, 41, 44, etc., between the channel 45 and the retainer 48, a series of mounting holes 62, 63, 64, 65, 66, etc., are formed into channel 45. A matching series of mounting holes 67, 68, 69, 70, 71, etc., is formed within retainer 48, thereby permitting bolts or other suitable fasteners 72, 73, 74, 75, 76, etc., to be inserted therethrough. The height of sidewall 61 of finger base portion 42 is slightly larger than the height of sidewalls 49, 50, 52 and 53, thereby causing finger base 42 to be in an abutting, slightly compressed state when the retainer 48 is affixed to channel 45. The bottom surface 149 of the finger 39, for example, is slightly concave, thereby creating a resilient, springy effect. In a preferred embodiment, the radius of curvature of surface 149 is less than the radius of curvature of surface 51, thereby creating a radially directed bias or spring effect within each finger.

The conveyor belt 27 has formed within its surface a matching series of mounting holes 77, 78, 79, 80, 81, etc., which permits the combined retainer 48 and channel 45, with the rubber fingers 39, 40, 41, 44, etc., sandwiched therebetween, to be rigidly affixed to the conveyor belt 27 by means of the bolts 72, 73, 74, 75, 76, etc. A series of circumferential grooves (not shown) are formed within conveyor axles 25 and 26 to prevent interference with the mounting bolts 72, 73, etc., as they pass over the rotating axles 25 and 26. The fingers 13, 14, 15, 16, etc., are mounted to collector drum 12 in a similar fashion, except that the bolts are secured directly to the axle surface 23, thereby eliminating the need for the aforementioned circumferential grooves.

Figure 4:
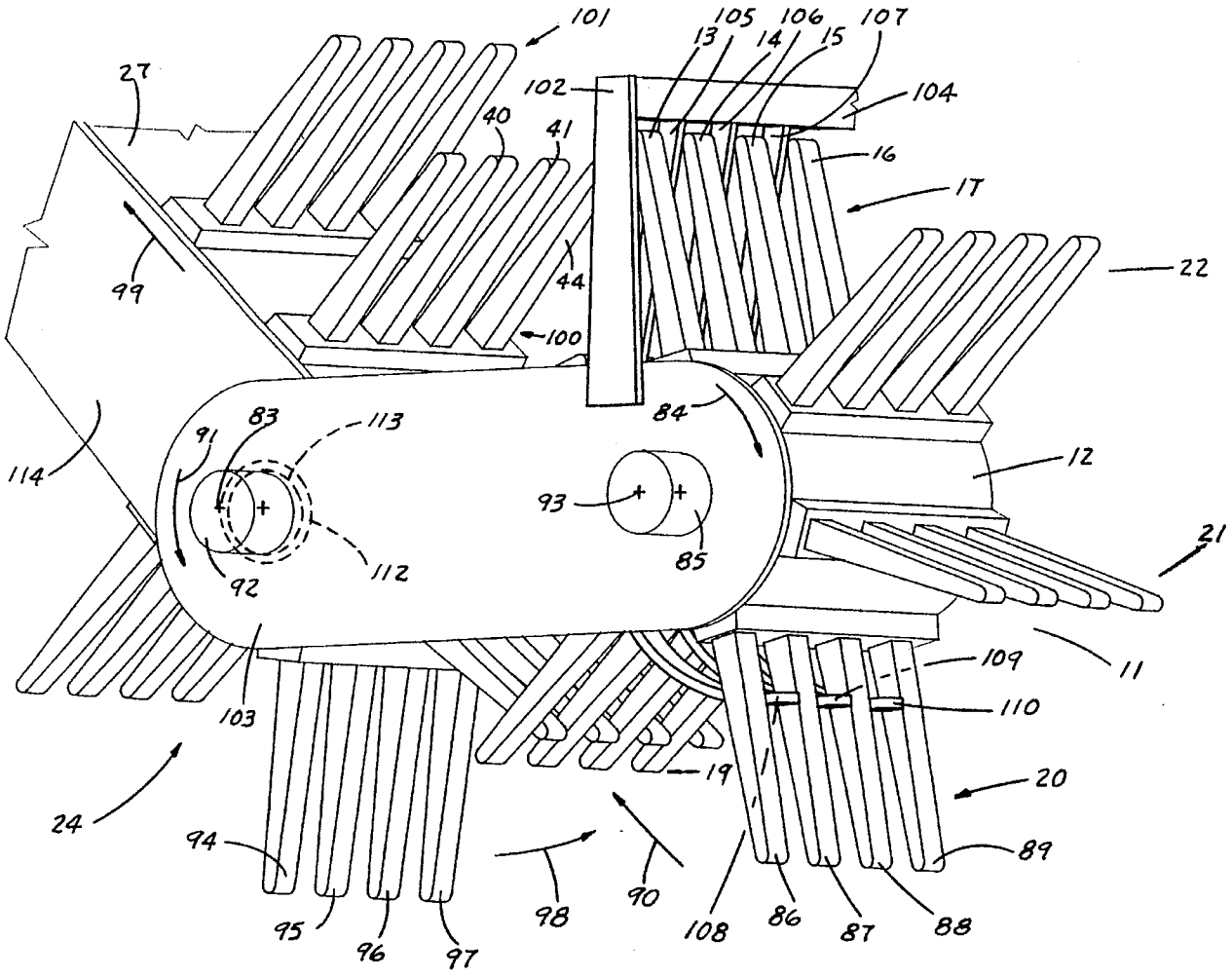
FIG. 4 is a right side perspective view of the collector and conveyor depicted in FIG. 2, showing in particular the relationship of the mounting hardware and the rakes, and omitting some parts for clarity.

Referring also to FIG. 4, additional operational details of the collector and conveyor hardware can be appreciated. In particular, the collector axle 12 as well as the entire conveyor belt 27 are moving generally in the direction of arrow 82 when the truck 2 is in normal forward motion. Additionally, when in a debris collecting mode, the collector axle 12 is engaged in a clockwise rotation about its longitudinal axis 93 as indicated generally by the direction of arrow 84. An hydraulic motor 85 with a rating of approximately two horsepower permits the collector axle 12 to be rotated at a rate of as much as approximately two hundred fifty revolutions per minute.

As debris (not shown) is encountered, the fingers 86, 87, 88, 89, etc., of the collector roller 12 cause the debris to be swept rearwardly, generally in the direction of arrow 90. At the same time, the lower conveyor axle 25 is rotating about its longitudinal axis 93 in a counterclockwise direction as indicated generally by the direction of arrow 91. An hydraulic motor 92 with a rating of approximately six horsepower permits the lower conveyor axle 25 to rotate at rates of as high as approximately three hundred revolutions per minute. Therefore, the conveyor fingers 94, 95, 96, 97, etc., are moving forwardly generally in the direction indicated by arrow 98. The resultant action of the rearward movement of collector fingers 86, 87, etc., and the forward movement of conveyor fingers 94, 95, etc., is to entrap the debris residing in the region between collector roller 11 and conveyor roller 24, thereby urging the debris upwardly and onto the upper surface of the conveyor belt 27, which is moving generally in the direction of arrow 99. Debris is prevented from sliding downwardly on the conveyor belt 27 by the presence of the successive rows 100, 101, etc., of rubber fingers mounted on the conveyor belt 27 in a spaced apart relationship.

Occasionally, a particular item of debris is encountered which is so large that it will not fit between the successive rows of fingers on the conveyor belt 27. In such cases, the debris tends to bounce along the tips of the rubber fingers, and due to the speed of the conveyor, deflect at high speed from the fingers and not always in the rearward direction of hopper 127. In order to encourage the entrainment of such debris, the conveyor 27 is constructed to include one or more gaps 153, occurring between rows 151 and 152, as best seen in FIGS. 1, 6, 7 and 8. The gap 153 is created by the absence of one or more rows of fingers, thereby creating a space of at least approximately one foot between the remaining adjacent rows of fingers. The gap 153 is thus sufficiently large to permit bulkier items settle between the rows of fingers and rest nearer to the surface of the belt 27, thereby facilitating conveying of such debris toward the hopper 127.

Certain types of debris, such as moist or elongated materials, may tend to cling to the rubber fingers mounted on the collector roller 11, thereby resisting the desired transfer of such debris onto the conveyor belt 27. In order to prevent the accumulation of such debris onto the collector axle 12, a rake 102 is mounted on end plate 103. The rake includes an upper horizontal member 104 from which is suspended a series of tines 105, 106, 107, etc., the tines 105–107 being arranged in a spaced apart relationship so as to reside between the fingers 13, 14, 15, 16, etc., of the collector roller 11 as the fingers 13–16 pass by the tines during the rotation of the collector axle 12. The tines 105–107 are attached to upper horizontal member 104 in a cantilevered relationship, each tine terminating beneath collector roller 12 at prongs 108, 109, 110, etc., respectively. Each tine is shaped so as to include a broad base which is attached to the horizontal member 104. Each tine follows a curved path so as to encircle a portion of the circumference of axis 93. Each tine tapers gradually toward a tip which terminates at an angular displacement, relative to axis 93, of approximately 190° from its base. Thus, at any given moment during a single rotational cycle of collector roller 11, some portion of the rake 102 elements 103–110, etc., reside immediately adjacent to all of the rubber fingers in four of the six rows 17–22 of fingers mounted on collector axle 12. In this manner, the likelihood of debris clinging to the collector roller 11 for more than a single rotational cycle is greatly reduced.

Normally, the positions of the lower conveyor roller 24 and the collector roller 11 will be adjusted such that the tips of the rubber fingers on each roller will come no closer than a half inch to the roadway surface 6. In some cases, however, debris will be encountered on the road which is fairly large and has a height on the order of two feet, making passage around the collector roller 11 difficult. Further, some types of debris, such as a rope or blanket, may be more readily entrained by the conveyor roller 24 without the presence of the collector roller 11, since their shape may tend to encourage fouling of the collector roller 11. In these situations, rotation of the collector roller 11 may be stopped altogether, or it may be even more advantageous to remove the collector roller 11 from the path of debris entrainment altogether. Referring to FIG. 4, one novel feature of the present invention is the interconnection of the collector roller 11 to the lower conveyor roller 24 by means of end plates 103 and 111, between which the lower conveyor axle 25 and the collector axle 12 are supported. The end plate 103 also serves as a convenient mounting platform for hydraulic motors 85 and 92. The interior surface of each end plate includes a circular groove, such as groove 112 on end plate 103, which engages a rail 113 formed on the outer surface of conveyor end plate 114. The rail 113 and groove 112 are concentric, the rail 113 rotating about the edges of groove 112, thereby supporting end plate 103 in a cantilevered fashion about axis 83. Thus, end plate 103 is laterally and longitudinally "anchored" at conveyor drum 25, but end plate 103 is nonetheless free to rotate about the conveyor drum 25, thereby cantilevering the collector drum 11 and permitting the entire collector drum 11 to pivot freely about the longitudinal axis 83 of the lower conveyor drum 25.

Figure 5:
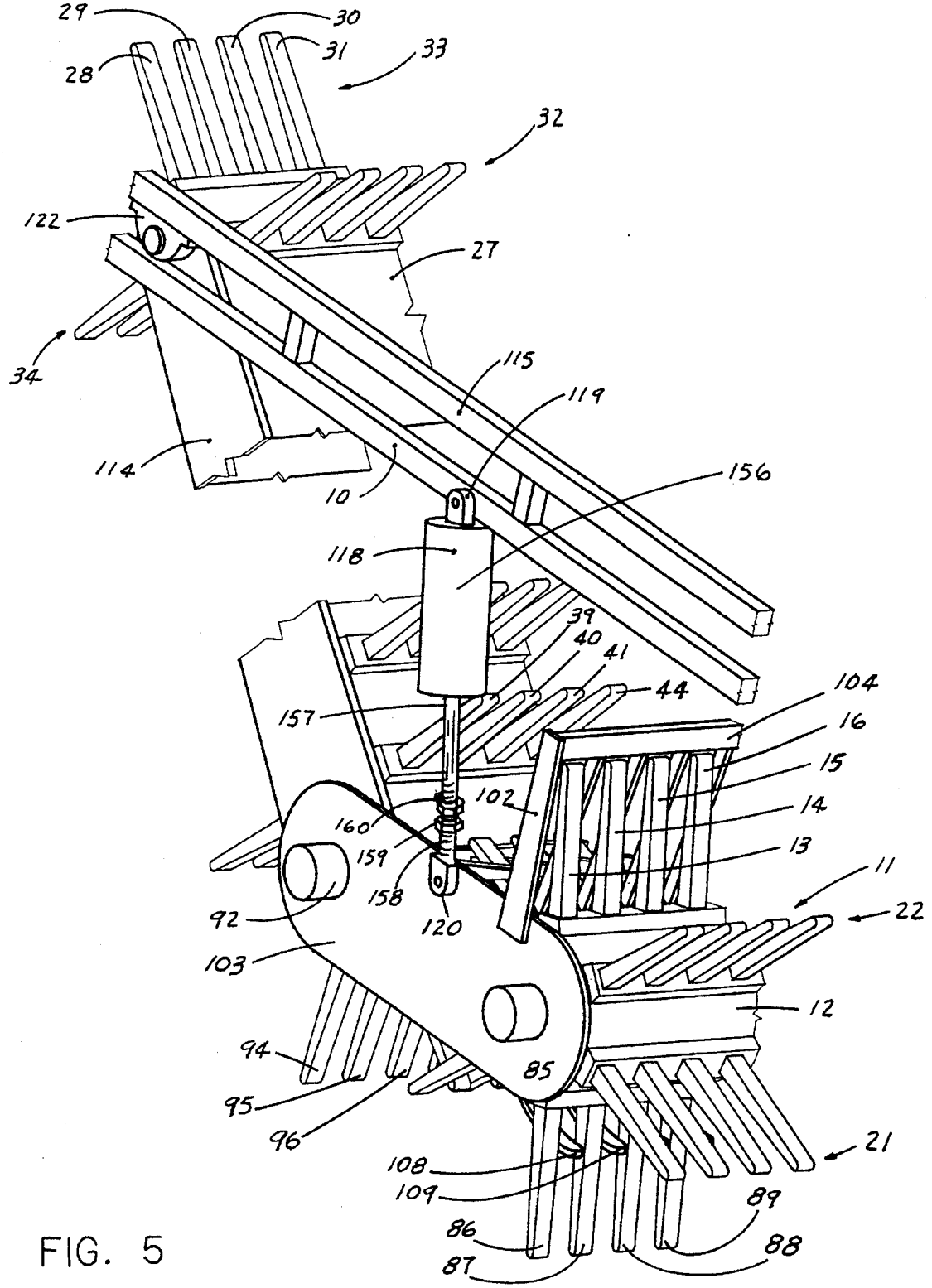
FIG. 5 is a right side perspective view of the collector and conveyor, showing in particular the manner in which they are connected to the frame of the vehicle.

Referring also to FIG. 5, the biasing and control of the collector roller 11 may be more readily understood. The frame which rigidly attaches to the rear surface 7 of vehicle 2 includes an upper horizontal member 115 and a lower horizontal member 10. The frame members 10 and 115 continue rearwardly and are supported near the back of the debris collection apparatus 1 by two pairs of wheels, including left side wheels 116 and 117. The lower frame member 10 serves as the support for the pivotable upper end 119 of an hydraulic cylinder 118. The lower end 120 of the cylinder 118 is pivotably attached to the right side end plate 103. A similar arrangement exists for the left side of apparatus 1, with hydraulic cylinder 121 being attached to left end plate 111. In operation, the hydraulic cylinders 118 and 121 can be raised so as to lift their respective end plates 103 and 111, thereby causing the collector roller 11 to be lifted above the road surface 6 by as much as approximately two feet. In an alternate embodiment of the invention, the hydraulic cylinders 118 and 121 are replaced by biasing extension springs 154 (see FIG. 1) which are supported at their upper ends by vertical frame member 8. The springs 154 could be adjusted to provide an upwardly biased floating support for the collector roller 11. The latter arrangement permits the collector roller to be readily deflected upwardly upon encountering larger debris, thereby permitting the collector roller 11 to "walk over" items which might otherwise jam or impede its operation. In either arrangement just discussed, at least some portion of the weight attributable to the collector drum 11 is transferred to the frame 9.

Figure 8:
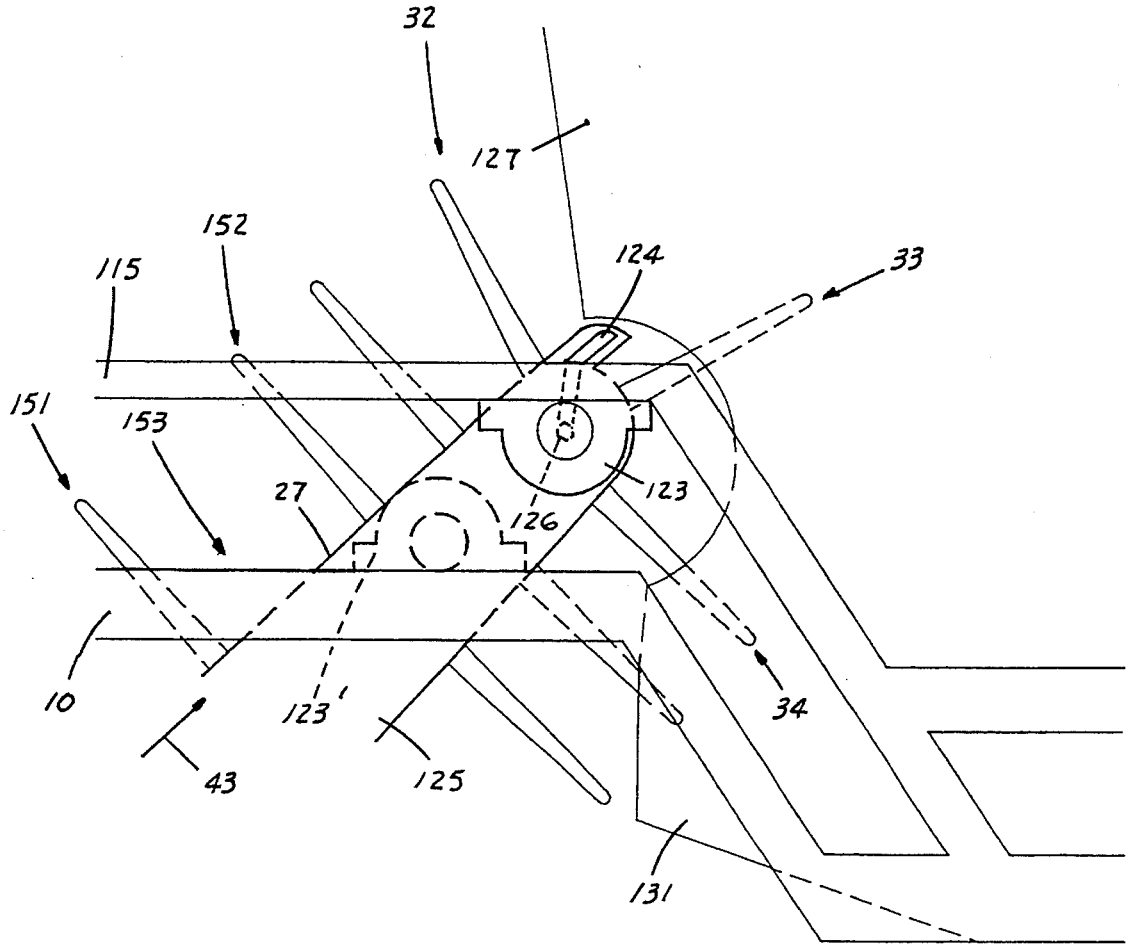
FIG. 8 is a left side elevation of a portion of the apparatus depicted in FIG. 1, showing the relationship of the conveyor, hopper and frame.

Referring also to FIG. 8, the upper conveyor roller 26 is seen to be pivotably supported by a right bearing 122 and a left bearing 123. This arrangement permits the entire conveyor belt 27 and particularly the lower conveyor axle 25 to deflect upwardly in response to unevenness in the road surface 6. Further, an additional pair of hydraulic rams 155 as shown in FIG. 1 may be placed between a tab 156 on frame member 10 and the conveyor end plate 125, thereby permitting the conveyor 27 to be lifted into a transport position when the vehicle is not engaged in actual litter collection operations.

As the rubber fingers of the conveyor 27 and collector 11 wear during normal operations, the nominal clearances between the fingertips and the road surface 6 must be maintained. Small adjustments may be made by retracting rams 155 just described, which has the effect of lowering the conveyor roller 25 and bringing the fingertips closer to the road surface 6. In one preferred embodiment, the rams 155 may be omitted and rigid members with pivotable ends may be substituted therefore as a support for conveyor 27. In order to perform coarse adjustments to the orientation of the conveyor 27 as finger wear becomes more acute, regardless of whether or not hydraulic rams 155 are present, a slot 124 is provided in the left conveyor end plate 125, and a similar slot (not shown) is formed in the right conveyor end plate 114. The central shaft 126 of upper conveyor axle 26 may be positioned at any location within the slot 124 in order to provide the proper clearance of lower conveyor roller 25 from the road surface 6. As the wear of the fingers becomes extreme, the bearing 123 may be repositioned by removing the bearing from upper frame member 115, inverting the bearing and mounting it on lower frame member 10 so as to occupy the position of bearing 123'. The bearing 123' resides in a substantially lower position than bearing 123, thereby permitting the lower conveyor roller 24 to be much closer to road surface 6.

Each of the hydraulic rams, such as hydraulic ram 118 shown in FIG. 5, may be modified in its construction to provide a positive "stop" mechanism which may be set by the vehicle operator to simplify daily operation. For example, ram 118 is seen to include a cylinder 156 and a piston 157. The base region 158 of the piston 157 is threaded and includes a pair of nuts 160 and 159 which may be placed in an abutting relationship to provide a positive stop on the piston 157. Alternatively, a threaded collar may be slid over piston 157 to accomplish the same result. This permits the operator to set the limit of travel for full retraction of ram 118 to a predetermined height, as may be appropriate for the transport position of collector 11. Alternatively, referring to the ram 155 of FIG. 1, the stop may be positioned on piston 189 adjacent to tab 156 in order to set the lowest point to which the conveyor roller 25 may travel upon full cylinder retraction. The stop may be advanced upwardly along piston 189 to preset the appropriate distance between the tips of the fingers and the road surface 6, based on a state of little or no finger wear. As finger wear occurs, the stop may be adjusted downwardly (toward tab 156) along piston 189, thereby decreasing the distance between conveyor roller 25 and road surface 6 when the ram 155 is fully retracted.

Figure 6:
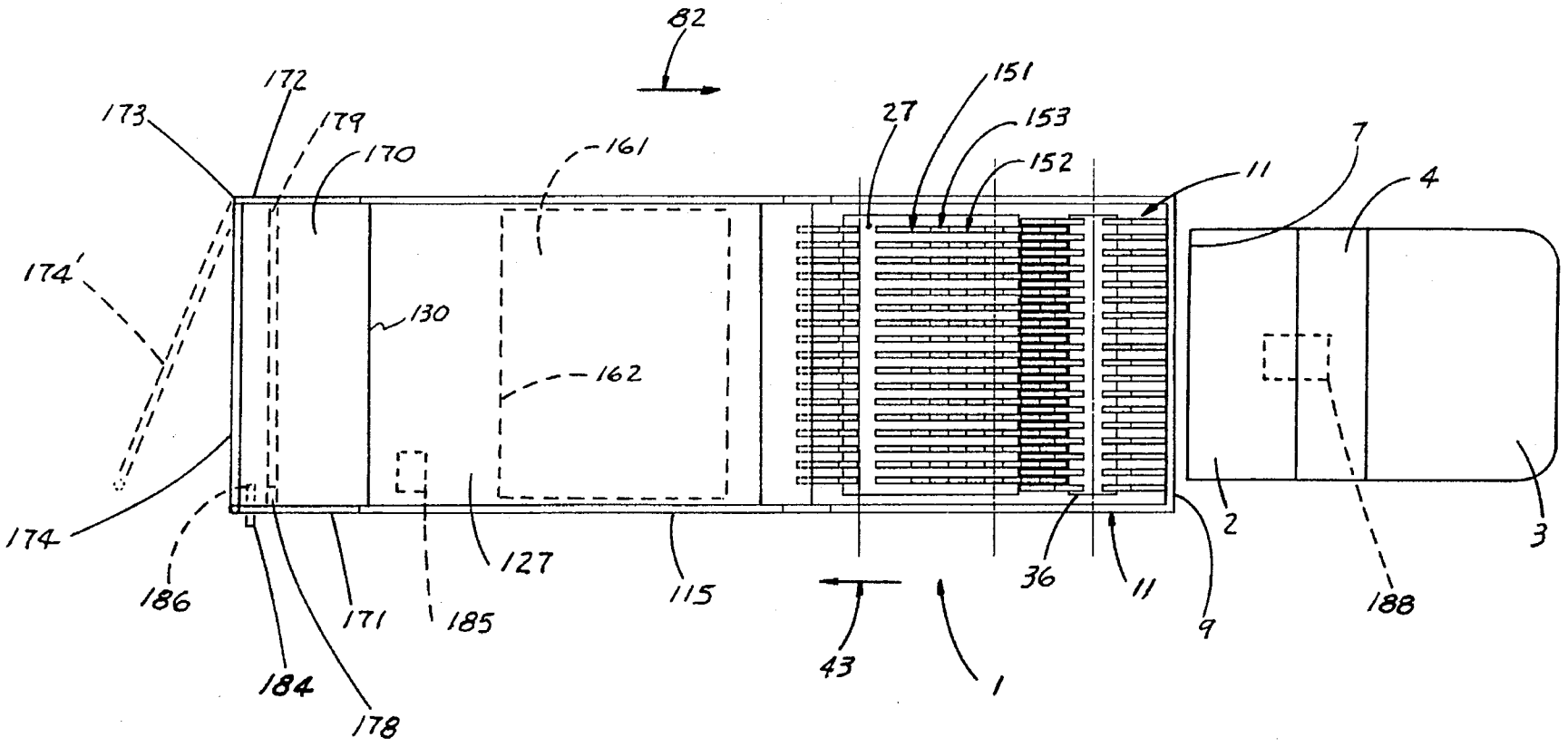
FIG. 6 is a top plan view of the debris collection apparatus depicted in FIG. 1.
Figure 7:
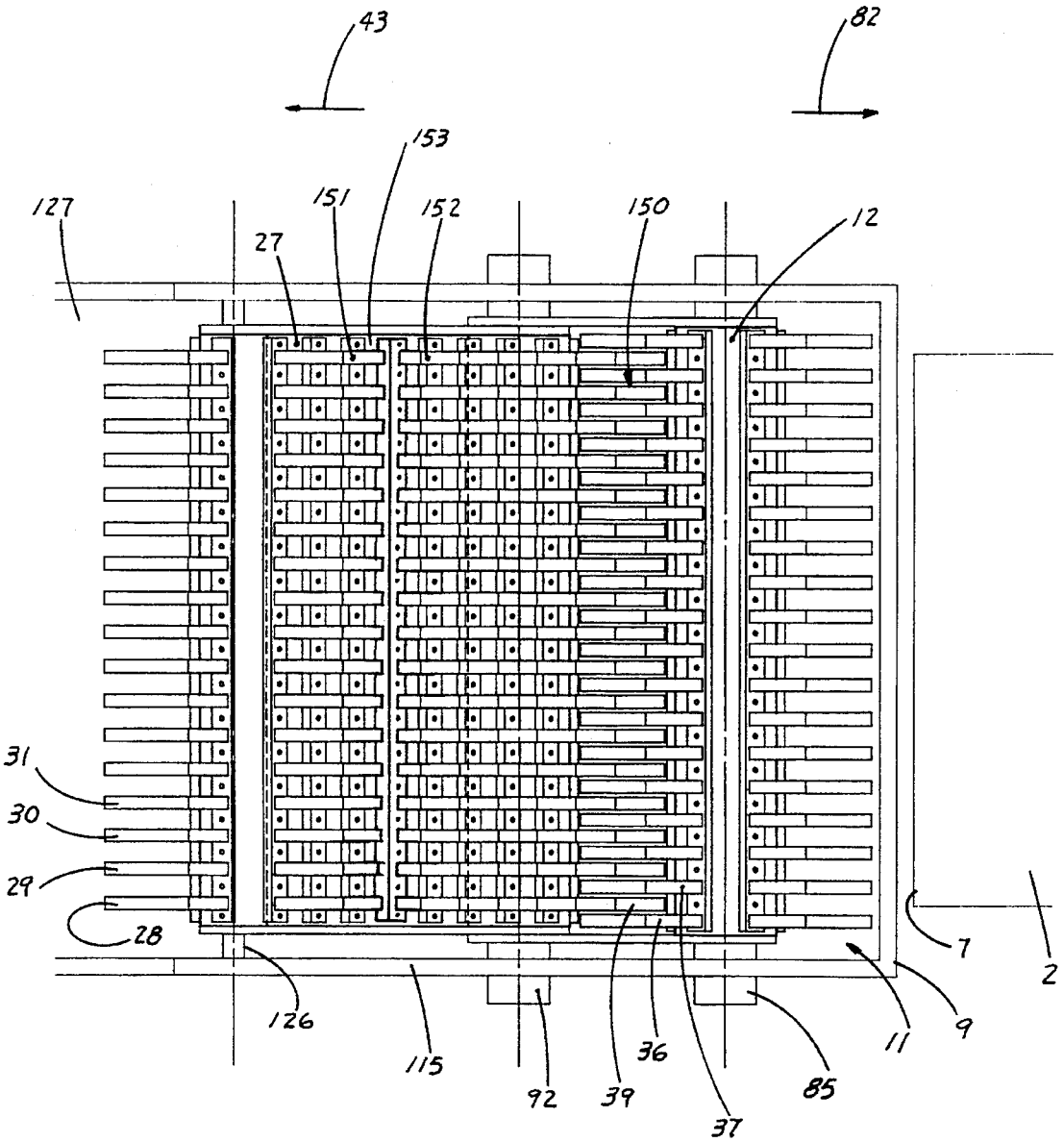
FIG. 7 is a top plan view of the collector and conveyor depicted in FIG. 6.

Referring also to FIGS. 6 and 7, the entrained debris moves in the direction of arrow 43 and is deposited in the hopper or collection bin 127. Due to the resilience of the rubber fingers, the angular acceleration of the conveyor 27 in the region of upper conveyor roller 26, as well as the inclination of conveyor belt 27, the debris is flung generally along the arcuate paths 128 or 129 (as best seen in FIG. 1), depending upon the weight of the debris, its aerodynamic characteristics, its radial location along the fingers when it reaches the upper roller 26 and the speed of the conveyor 27. However, for most types of debris, the debris will assume a trajectory toward the rear wall 130 of hopper 127, causing the hopper to fill initially at its rear most region and progressively move forward in the direction of arrow 82, thereby insuring maximum utilization of the hopper capacity.

Referring again to FIG. 1, although most debris will be directed toward the rear of the hopper 127 as just discussed, some debris, due to its light weight or the random manner in which it encounters the resilient fingers, will be deflected upwardly. This is especially likely in the region of upper conveyor roller 26 due to the acceleration of the fingertips as they pass from the top to the bottom of the conveyor belt 27. In order to prevent such upwardly directed debris from exiting the vehicle 1, a hood 166 extends from the rear of cab 2 to the leading edge 167 of hopper 127. The hood 166 is constructed of expanded metal or grille material and extends across substantially the entire width of the conveyor 27. Debris is redirected in the region of upper conveyor roller 26 by baffle plate 168, which is attached along its upper edge to the hood 166 at hinge 169. The baffle 168 is preferably constructed of either a flexible material or expanded metal surrounded by a rigid frame. As shown in FIG. 1, the baffle 168 is suspended in a vertical orientation when the vehicle 1 is at rest. However, when the vehicle 1 is in operation, the forward motion of the vehicle 1 as well as the rearward movement of air caused by the operation of the conveyor 27 causes the baffle 168 to swing rearwardly. The rearwardly slanted orientation of the baffle 168 causes vertically traveling debris which encounters the baffle 168 to be deflected downwardly and rearwardly so as to either fall back onto conveyor 27 or to travel directly into the hopper 127.

As best seen in FIGS. 1 and 6, in order to assist in filling the entire hopper 127, a compression plate 161 may be employed, which can consist of a substantially rectangular piece of expanded metal or grillework approximately five feet in length and extending for the width of the hopper. The plate 161 is hinged along its base 162, permitting the plate 161 to be lowered as shown in FIG. 6 and lie on the bottom of hopper 127. As the hopper 127 becomes full, the plate 161 may be raised, as shown in FIG. 1, by means of a winch and cable (not shown), thereby assuming a substantially vertical position and confining debris in the rear portion 163 of hopper 127, the debris thereby tending to extend or stack to the ceiling 165 of the hopper 127. In this manner, the forward portion 164 (see FIG. 1) of hopper 127 is "emptied" and can thereby be more readily filled with subsequently collected debris.

In some situations such as the collection of animal carcasses, the refuse cannot be mixed with the other contents of the hopper 127 since such refuse must be segregated and disposed of at a special facility. When collecting an animal carcass with the apparatus 1, the vehicle 2 is moved forwardly at a relatively low velocity, such as ten miles per hour. The collection roller 11 is operated at a relatively slow rate, such as fifty revolutions per minute, and the conveyor 27 is operated at a very low velocity, such as one foot per second or less. Thus, the carcass will not tend to be flung toward the rear of hopper 127, but rather will tend to drop vertically downward upon passing over upper conveyor roller 26.

Figure 9:
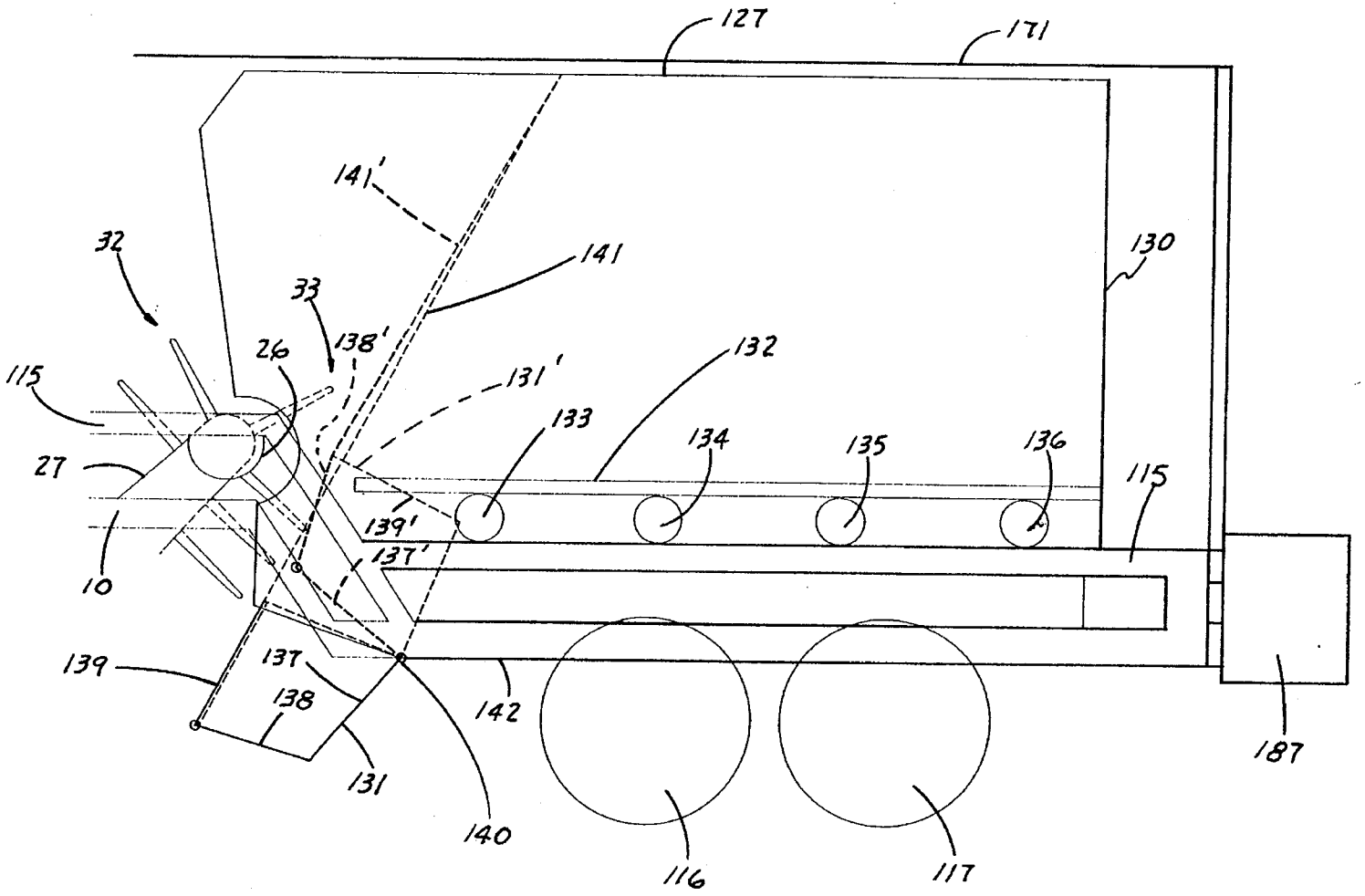
FIG. 9 is a left side elevation of a portion of the apparatus depicted in FIG. 1, showing in particular the relationship of the conveyor, hopper and carcass storage compartment.

In order to house the carcass within hopper 127, a novel carcass collection box 131 is utilized. Referring particularly to FIG. 9, the carcass collection box 131 normally resides in a stored position 131' within hopper 127. In the stored position 31', the carcass collection box serves as a front wall or barrier along the lower edge of the hopper 127, thereby preventing collected refuse within the hopper 127 from falling back onto the roadway surface 6. The collection box 131 is formed to include a rear wall 137, a bottom wall 138 and a front wall 139. The box 131 is pivotably attached to the bottom front corner 140 of the hopper 127, and is held in its upward, stored position by means of cable 141, which may be manipulated by means of a suitable pulley arrangement (not shown).

The size of the carcass box 131 is too large to permit is to be lowered while the hopper 127 is in its operative position due to interference with the conveyor 27. Therefore, when the collection of a carcass is anticipated, the vehicle 2 is stopped at some convenient location. The hopper 127 is formed to include a longitudinal rail 132 on each side, the hopper 127 being slidably supported by rails 132 riding above the upper horizontal frame member 115 by means of rollers 133, 134, 135 and 136. The hopper 127 can thus be moved rearwardly a suitable distance, such as two feet, in order to permit the lowering of the carcass box 131. The cable 141 is then lowered, thereby permitting box 131 to occupy a position substantially below the lower edge 142 of hopper 127, as well as beneath and somewhat behind the upper conveyor roller 26. After the box 131 is lowered, the hopper 127 can then be moved forwardly into its operative position and secured by suitable means (not shown). In practice, the box 131 is generally always lowered unless an unusually long period of vehicle transport (without collection activity) is anticipated.

The carcass can then be entrained onto the conveyor 27 and due to the low speed of conveyor 27, the carcass will drop almost vertically after passing upper conveyor roller 26 and fall into the carcass collection box 131. The normal, higher conveyor 27 velocities can then be resumed as other types of litter are collected, the latter debris being flung rearwardly into the hopper 127 and tending to fall well behind and clear of the collection box 131.

Figure 10:
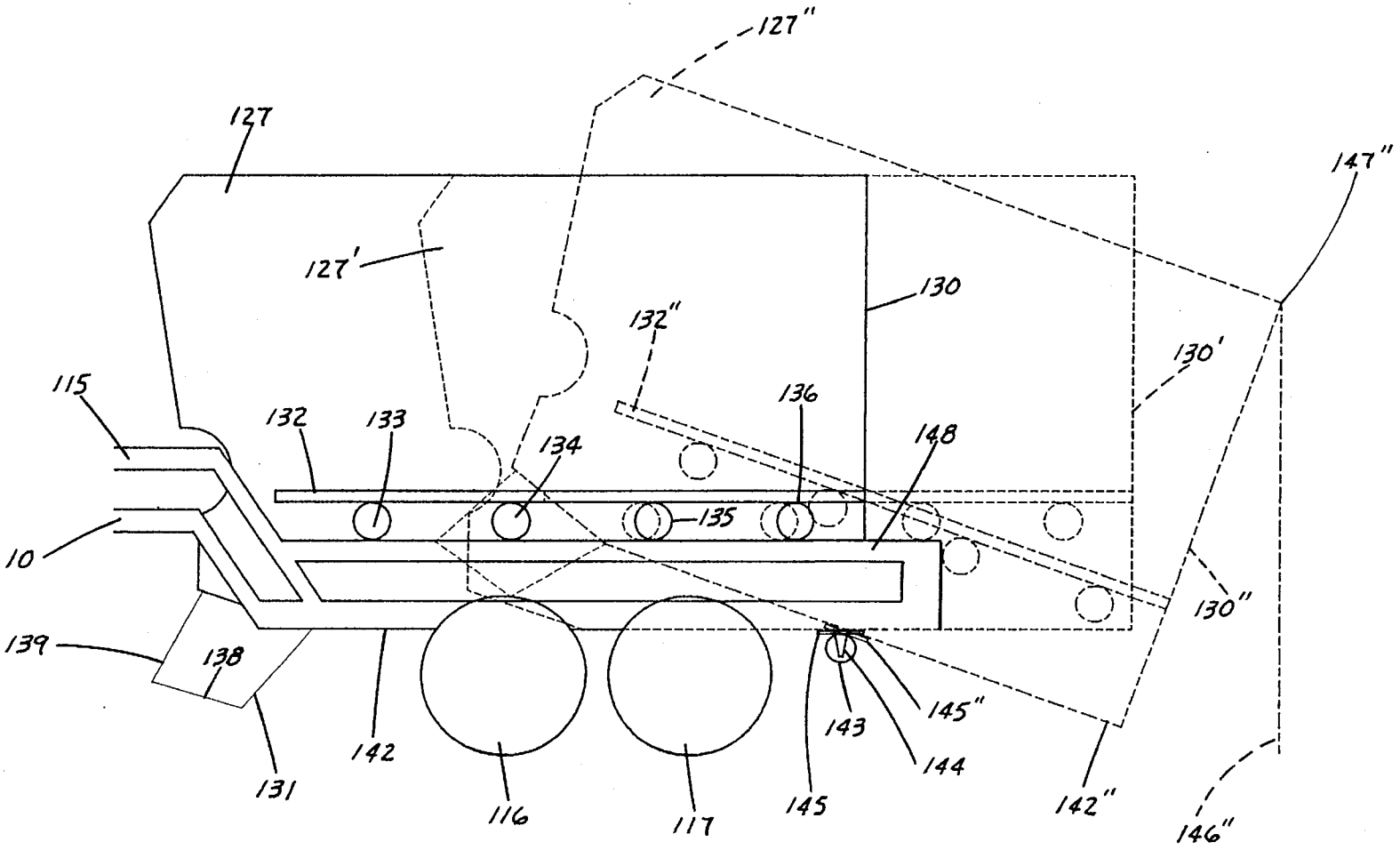
FIG. 10 is a left side elevation of a portion of the apparatus depicted in FIG. 1, showing in particular details of the hopper unloading scheme utilized in the present invention.

When the hopper 127 is full, the apparatus 1 is driven to a suitable refuse receiving site or is approached by a "shadow" truck. A shadow truck is a vehicle which can carry an empty hopper 127 and which can therefore exchange an empty hopper for a full hopper as needed. In the case of a shadow truck, the hopper 127 must be moved from the vehicle 1 to the shadow truck in a substantially level orientation. When the vehicle 1 goes directly to a refuse collection site, the hopper 127 will often need to be inclined so as to empty or "dump" its contents. The novel design of the present invention eliminates the need for special equipment in order to empty or exchange hopper 127, as can best be appreciated by reference to FIGS. 1, 9 and 10. In the dumping mode, the hopper is initially in the position 127, which is the position occupied by the hopper during normal refuse collection and transport operations. At the refuse collection site, the hopper 127 is initially rolled rearwardly over bearings 133–136, until the position occupied by the hopper 127' is reached, at which point the hopper center of gravity is approximately over the rearmost portion 148 of the frame members 115 and 10. Mounted beneath the lower frame member 10 in the region of rearmost frame portion 148 is a pipe 143, the pipe 143 being mounted in a cradle 144 such that the pipe 143 is free to rotate about its longitudinal axis. Rigidly mounted on the top of the pipe 143 is a plate 145, the plate 145 extending across substantially the entire width of the hopper 127.

When the hopper has reached the position 127', the hopper may be tilted such that the rearmost region 130' moves downwardly to assume generally the position 130". The bottom 142' of hopper 127' is supported by the plate 145, which pivots to assume position 145" when the bottom of the hopper is in position 142". Tilting of the hopper to position 127" causes rear door 146" to swing open, insofar as the door 146" is hinged along the top edge 147" of the hopper 127". In this manner the hopper 127" may be readily emptied, and the hopper pushed back to its operative position 127 and secured for further use.

When the full hopper 127 is to be exchanged for an empty hopper from a shadow vehicle, the hopper is rolled rearwardly to the position 127'. At that point a pair of jacks or stands may be inserted into suitable fittings (not shown) on the sides of the hopper, which will stabilize the rear of the hopper and permit the vehicle 1 to be driven forward until an additional pair of jacks or stands is inserted into fittings near the front of the hopper 127, thereby supporting the entire weight of the hopper 127 on the stands. The vehicle 1 can then be driven completely away and repositioned to accept an empty hopper from the shadow vehicle.

In some cases debris will be encountered on the road surface 6 which cannot possibly be ingested by collector 11 and conveyor 27 assembly. Such debris might include ladders, conduits or water heaters. In such cases, the vehicle operator must nonetheless retrieve these items and place them somewhere on the vehicle 1. In order to deal with this eventuality, a storage space 170 exists at the rear of vehicle 1. As best seen in FIGS. 1, 6 and 9, the vehicle frame 115 extends beyond the rear surface 130 of the hopper 127 for a distance of approximately two feet. The entire hopper and conveyor assembly is enclosed by paneling 171 which also extends to the rearmost extremity 172 of frame 115. The end of frame 115 is formed to include a hinge 173 upon which is supported a swinging door 174. As seen in FIG. 6, the door is partially opened at position 174'. Further, as best seen in FIG. 1, the door 174 is divided by a centrally located hinge 176 which links upper panel 175 and lower panel 177. Thus, a completely enclosed storage area 170 is created which may be readily accessed by opening door 174.

The door 174 also serves as a convenient mounting surface for an attenuator 187 (see FIG. 9), the attenuator being a device for absorbing a rear impact, such as might be encountered when a car traveling at a high rate of speed failed to appreciate that the vehicle 1 of the present invention is moving forward at a substantially slower velocity. Although the vehicle 1 includes a top mounted directional sign (not shown) directing traffic to an adjacent lane, the attenuator provides an additional level of safety. A suitable attenuator is the Model Number 3523750, manufactured by Energy Absorption Systems, Incorporated, One East Wacker Drive, Chicago, Ill. 60601, telephone number (312) 467-6750.

Figure 11:
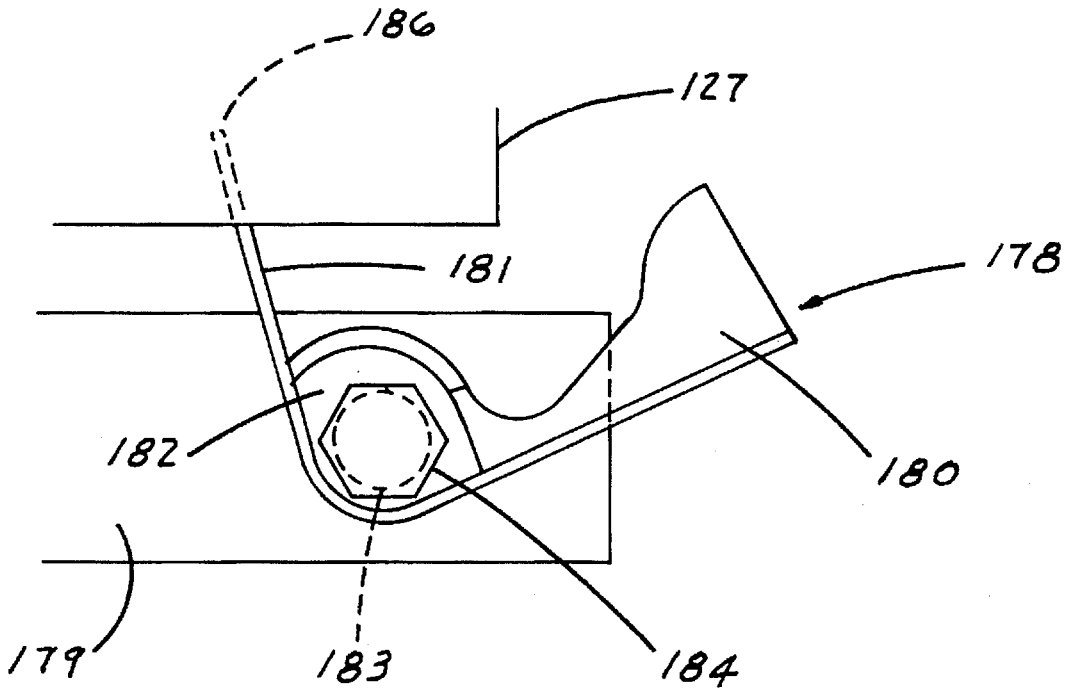
FIG. 11 is a rear elevational view of a gravity operated stop mechanism shown engaging the hopper of the present invention.

The hopper 127 is normally affixed to the frame 115 by suitable lockdown pins (not shown). However, the possiblity always exists that a vehicle operator, when exchanging or emptying the hopper 127, will unknowingly park the vehicle 1 on unlevel ground. In such cases, when the lockdown pins are removed the hopper 127 could begin rolling rearwardly due to the force of gravity. In order to prevent this situation, a gravity operated "stop" 178 (see FIG. 11) is mounted on a lower portion of the vehicle frame 179 which extends laterally across the width of the vehicle 1 immediately in front of door 174. The stop 178 includes a weighted head 180 mounted opposite a hopper engaging tab 181. A central flange 182 includes a mounting hole 183 through which bolt 184 is inserted. The stop 178 is free to pivot about the longitudinal axis defined by the bolt 184, the weight 180 causing the stop 178 to reside in the position shown in FIG. 11. A rectangular opening 185 (see FIG. 6) is formed in the bottom of the hopper 127 and engages the upper end 186 of the stop 178 when the hopper 127 slides a sufficient distance rearwardly. The weight 180 protrudes to the side of the hopper 127 and may be readily lifted by the vehicle operator as desired since it is adjacent to the area that is occupied by the operator when hopper exchanges are being made.

In operation, a control panel 188 (see FIG. 6) is mounted in the cab 2 to control operation of the collector and conveyor. The control panel 188 is interconnected in a standard fashion to a reservoir and pump (not shown), and through appropriate hydraulic lines and fittings (not shown) is connected to each of the hydraulic devices, such as motors and rams, previously described herein. In particular, the control panel 188 can cause either the conveyor 27 or collector 11 to go in a clockwise or counterclockwise direction, a useful feature used to unjam debris. Further, panel 188 includes potentiometers to control collector and conveyor speeds, which are displayed on tachometers. Other switches on the control panel permit the conveyor to be raised or lowered, and to activate the hydraulic pump used to pressurize the hydraulic motors and cylinders. A separate master switch engages the power take off unit which actually engages and disengages the hydraulic pump. In a preferred embodiment dual driving controls, including a steering wheel and foot pedals, are mounted on the passenger side of the cab 2 to permit the vehicle operator to better view debris that may be located near the shoulder of the road surface 6.

Although the invention has been described with reference to specific embodiments, many modifications and variations will be obvious to those skilled in the art. For example, the vehicle 2 and frame 8 need not be rigidly attached to form a single integrated vehicle, but rather the frame 8 could be towed behind a separate motor vehicle which is capable of being used for other purposes. Also, the resilient fingers disclosed herein could have a variety of different shapes and be composed of many different materials.

Further, one or more boom mounted rotary gutter brooms could be affixed to the side of the vehicle 1 in order to dislodge debris from the shoulder of the road and direct it to a region in front of the vehicle where it could be entrained by the collector and the conveyor. The invention is not limited to the disclosed examples. Rather, the limits of the invention are precisely defined only in the following claims and their equivalent structures.

We claim:

1. A refuse collection apparatus, comprising;

(a) a prime mover;

(b) a collector, the collector being pivotably mounted to frame, the collector being driven by the prime mover;

(c) a conveyor, the conveyor being pivotably mounted to the frame and being driven by the prime mover, the conveyor being positioned to receive refuse from the collector, the conveyor further comprising:

(i) a first axle, the first axle having a first diameter;

(ii) a second axle, the second axle having a second diameter, the second diameter being smaller than the first diameter; and (iii) a belt, the belt extending as an endless loop between the first and second axle;

(d) a hopper, the hopper being slidably mounted to the frame, the hopper being positioned to receive refuse from the conveyor;

(e) a plurality of resilient fingers, each resilient finger comprising:

(i) a tapering four sided shaft, the shaft having a substantially rectangular cross section; and (ii) a radiused tip region, the resilient fingers being mounted on the collector and the conveyor, the resilient fingers mounted on the collector extending radially from the collector and tending to entrain debris encountered on a road surface and to deposit the debris onto the conveyor, the resilient fingers on the conveyor extending substantially perpendicularly from the conveyor and having a maximum tip velocity in a region adjacent to the second axle of the conveyor and tending to urge debris received from the collector toward the hopper, the resilient fingers mounted on the collector being laterally offset from the resilient fingers mounted on the conveyor; and (f) at least one conveyor end plate, the conveyor end plate extending between the first conveyor axle and the second conveyor axle;

(g) at least one collector end plate, the collector end plate having a first end and a second end, the first end being pivotally mounted to the conveyor end plate, and the second end being pivotally secured to the collector; and (h) a rake, the rake being rigidly affixed to the collector end plate, the rake being formed so as to include a plurality of tines, at least some of the tines residing between a majority of the resilient fingers mounted on the collector.

2. The apparatus of claim 1, wherein at least one tine is formed so as to include a base portion and a tip portion, the tine residing along a curved path radially displaced from the collector such that the base portion is angularly displaced at least 180° from the tip portion.

3. The apparatus of claim 2, further comprising biasing means, the biasing means being cooperatively connected to the collector end plate so as to transfer at least a portion of weight attributable to the collector to the frame.

4. A debris collection machine, comprising;

(a) a motor vehicle;

(b) a rigid frame, the rigid frame being rigidly affixed to the motor vehicle;

(c) debris entrainment means interconnected to the rigid frame, the debris entrainment means including plurality of entrainment fingers rotating about a first axle at a first rate;

(d) debris conveying means interconnected to the frame, the debris conveying means being pivotably interconnected to the debris entrainment means, the debris conveying means including a plurality of conveying fingers, the conveying fingers and the entrainment fingers occasionally interlacing so as to form a substantially continuous surface for transporting debris;

(e) a collection hopper, the debris conveying means being adapted to deposit debris into the hopper along an arcuate path toward a rearmost region of the hopper; and (f) at least one debris entrainment means support bearing rigidly affixed to the frame in one of a plurality of locations, the bearing being repositionable at any of the locations so as to reorient the debris entrainment means in response to wear of the entrainment fingers.

5. A debris collecting device, comprising:

(a) a motor vehicle;

(b) at least one upwardly extending post, the upwardly extending post being rigidly affixed to the motor vehicle;

(c) a substantially horizontal frame, the frame being affixed to and extending rearwardly from the motor vehicle;

(d) at least one collector roller, the collector roller being rotatable about a collector axle, the collector axle being affixed to the frame;

(e) at least one conveyor, the conveyor being secured to the frame, the conveyor being positioned so as to receive debris entrained by the collector roller;

(f) a hopper, the hopper being affixed to the frame, the hopper being positioned so as to receive debris conveyed by the conveyor;

(g) at least one upward biasing spring, the biasing spring being affixed at a first end to the post, the biasing spring being affixed at a second end to the collector roller, the biasing spring lightening the collector roller so as to facilitate passage of the collector roller over debris;

(h) a housing, the housing substantially enclosing the collector roller, the conveyor and forward regions of the hopper, the housing being rigidly affixed to the frame; and (i) a rear door, the rear door being affixed to the housing, the rear door being spaced apart from rear regions of the hopper such that a storage area is created between the hopper and the rear door.

6. The debris collecting device of claim 5, further comprising a baffle plate, the baffle plate being swingably mounted from the housing in a region overlying the conveyor, the baffle plate redirecting debris propelled from the conveyor with a substantial vertical component in a direction away from the baffle plate.

7. The debris collecting device of claim 6, further comprising a debris compression plate, the debris compression plate being hingedly mounted on an interior surface of the hopper, the compression plate being pivotable so as to retain and compress debris within the hopper against an interior surface of the hopper.

8. The debris collecting device of claim 7, further comprising at least one hydraulic cylinder, the hydraulic cylinder being pivotally affixed at a first end to the frame, the hydraulic cylinder being pivotally affixed at a second end to the conveyor, the hydraulic cylinder thereby being adapted to raise and lower the conveyor.

9. The debris collecting device of claim 8, wherein the hydraulic cylinder further comprises:

(a) a piston;

(b) a threaded sleeve, the threaded sleeve coaxially surrounding the piston; and (c) at least one nut, the nut being threadably secured to the threaded sleeve, the nut serving as a stop to limit movement of the hydraulic cylinder.

10. The debris collecting device of claim 9, further comprising a hopper stop, the hopper stop being pivotally affixed to the frame, the hopper stop being biased to engage a portion of the hopper, thereby preventing movement of the hopper.

11. The debris collecting device of claim 10, wherein the conveyor further comprises irregularly spaced rows of radially projecting fingers, the irregular spacing of the rows thereby permitting debris of various sizes to be entrained by the conveyor.

12. The debris collecting device of claim 11, further comprising at least one attenuator, the attenuator being affixed to an exterior surface of the rear door, the attenuator thereby absorbing impact to the collecting device caused by a collision with another object.

13. The debris collecting device of claim 12, further comprising at least one vertically extending baffle plate, the vertically extending baffle plate being mounted to a lower region of the frame adjacent to the collector, the vertically extending baffle plate tending to prevent debris encountering the collector from exiting an area defined by the planform of the collecting device.

* * * * *